US008439496B2

(12) United States Patent
Naivelt et al.

(10) Patent No.: US 8,439,496 B2
(45) Date of Patent: May 14, 2013

(54) DRUM PRINTER WITH AUTOMATIC LOADING AND UNLOADING

(75) Inventors: Vladimir Naivelt, Petach-Tiqwa (IL); Aharon Korem, Herzeliya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 349 days.

(21) Appl. No.: 12/679,649

(22) PCT Filed: Oct. 30, 2007

(86) PCT No.: PCT/US2007/022947

§ 371 (c)(1), (2), (4) Date: May 20, 2010

(87) PCT Pub. No.: WO2009/058116

PCT Pub. Date: May 7, 2009

(65) Prior Publication Data

US 2010/0258016 A1 Oct. 14, 2010

(51) Int. Cl.
*B41J 2/01* (2006.01)

(52) U.S. Cl.
USPC ..... 347/104

(58) Field of Classification Search ..... 347/104
See application file for complete search history.

(56) References Cited

U.S. PATENT DOCUMENTS

| | | | | |
|---|---|---|---|---|
| 4,783,669 | A * | 11/1988 | Piatt et al. | 346/134 |
| 6,084,602 | A * | 7/2000 | Rombult et al. | 346/134 |
| 6,120,143 | A * | 9/2000 | Narushima et al. | 347/104 |
| 6,471,334 | B2 * | 10/2002 | Kline et al. | 347/49 |
| 6,821,039 | B2 * | 11/2004 | Lewis | 400/649 |
| 2009/0033732 | A1 * | 2/2009 | Naivelt | 347/104 |

* cited by examiner

*Primary Examiner* — Manish S Shah
*Assistant Examiner* — Jeffrey C Morgan

(57) ABSTRACT

A small footprint drum inkjet printer having a print head consisting of a number of print head arrays; a substrate carrier preferably in the form of a drum with vacuum orifices therein, a substrate loading cassette capable of movement, relative to the drum, in at least one direction; a substrate unloading cassette capable of movement, relative to the drum, in at least one direction, and a curing radiation source having a reflector which extends along the drum surface.

18 Claims, 1 Drawing Sheet

DRUM PRINTER WITH AUTOMATIC LOADING AND UNLOADING

FIELD OF THE INVENTION

The present invention is concerned with a drum printer, in particular an inkjet printer, which has increased throughput.

BACKGROUND OF THE INVENTION

Drum printers are known in the printing industry. These are usually high throughput machines, such as HP Scitex TJ8000 and TJ8300 that print on flexible and semi-rigid substrates wrapped around the drum. Auxiliary devices, such as ink curing or drying devices, loading devices, etc. are arranged close to the drum surface. Substrate loading and unloading processes, when performed manually or automatically from a roll of substrate material, require the printing drum to be static at the time of substrate loading. Drying/curing of printed image requires a relatively long substrate pass that increases significantly the footprint of the printer. Drum printers also have a fixed throughput defined by the number of print heads or arrays operative for printing, although in some cases change of throughput is desired.

SUMMARY OF THE INVENTION

According to a first aspect of the invention there is provided a printing method comprising the steps of;
loading a substrate onto a substrate carrier from a loading cassette;
printing an image onto said substrate;
unloading said substrate from said substrate carrier onto an unloading cassette;
and wherein said loading and/or unloading steps comprise relative displacement between said loading and/or unloading cassette and said substrate carrier.

Preferably, the relative displacement is achieved by displacement of the loading cassette and/or the unloading cassette.

Preferably, said relative displacement comprises generally linear reciprocating movement.

Preferably, said relative displacement comprises displacement of said loading and/or unloading cassette relative to said substrate carrier along a path generally tangential to said substrate carrier.

Preferably, said relative displacement comprises displacement of said loading and/or unloading cassette relative to said substrate carrier along a path generally radially of said substrate carrier.

Preferably, said relative displacement comprises rotational displacement of said substrate carrier.

Preferably, the method comprises the step of adhering said substrate to said substrate carrier by the application of a vacuum between said substrate and said substrate carrier.

Preferably, said loading and unloading steps occur concurrently.

Preferably, the method comprises the step of directing curing radiation onto said substrate during the entire printing process.

According to a second aspect of the invention there is provided a printing method comprising the steps of;
loading a substrate onto a substrate carrier;
printing an image onto said substrate;
unloading said substrate from said substrate carrier;
and wherein said loading and unloading steps occur concurrently.

Preferably, said loading and/or unloading steps comprise relative displacement between said loading and/or unloading cassette and said substrate carrier.

Preferably, the relative displacement is achieved by displacement of the loading cassette and/or the unloading cassette.

Preferably, said relative displacement comprises generally linear reciprocating movement.

Preferably, said relative displacement comprises displacement of said loading and/or unloading cassette relative to said substrate carrier along a path generally tangential to said substrate carrier.

Preferably, said relative displacement comprises displacement of said loading and/or unloading cassette relative to said substrate carrier along a path generally radially of said substrate carrier.

Preferably, said relative displacement comprises rotational displacement of said substrate carrier.

Preferably, said relative displacement comprises linear displacement of said substrate carrier.

Preferably, the method comprises the step of adhering said substrate to said substrate carrier by the application of a vacuum between said substrate and said substrate carrier.

According to a third aspect of the invention there is provided a printer comprising;
a print head;
a substrate carrier;
a substrate loading cassette;
a substrate unloading cassette;
and means for effecting relative displacement between said substrate carrier and said substrate loading and/or unloading cassette.

Preferably, said substrate carrier comprises a drum having an array of vacuum orifices therein.

Preferably, said displacement means is adapted to effect displacement of the loading cassette and/or the unloading cassette.

Preferably, the printer comprises a source of curing radiation.

Preferably, said displacement means is adapted to effect displacement of the drum.

DETAILED DESCRIPTION OF THE DRAWINGS

Figure 1:
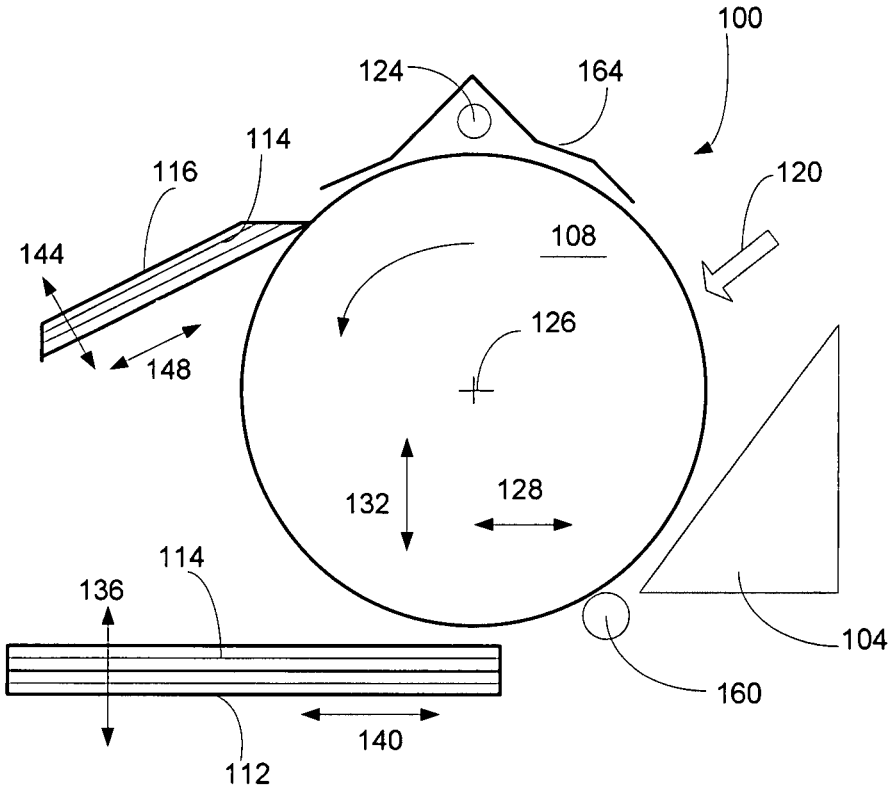
FIG. 1 is a schematic illustration of a side view of an exemplary embodiment of a printer according to one aspect of the invention and for performing a method of printing according to additional aspects of the invention.

FIG. 1 is a schematic illustration of a side view of an exemplary embodiment of a printer according to one aspect of the invention. The printer 100 consists of an inkjet print head 104 or an array of print heads, a substrate carrier such as for example, a drum 108, a substrate loading cassette 112, a substrate unloading cassette 116, a uniform air flow development device such as an air knife 120 or the like, and a curing radiation source 124.

In use the drum 108 rotates around its rotational axis 126 and in addition it may undergo displacement relative to the loading cassette 112 and/or the unloading cassette 116. In one mode of operation the drum 108 is adapted to perform a reciprocal linear movement toward and away from loading cassette 112 as illustrated by arrow 128. In another mode of operation, the drum 108 is capable of performing a reciprocal linear movement up and down from its nominal position as illustrated by arrow 132.

In a further mode of operation, the loading cassette 112 with blank substrates 114 is capable of performing a reciprocal linear movement up and down from its nominal position, as illustrated by arrow 136. This reciprocating movement or displacement is thus in a direction generally radially of the drum 108. Alternatively or additionally, and as shown by arrow 140, the loading cassette 112 may be capable of performing a reciprocal linear movement towards and away from the drum 108. This reciprocating movement is in a direction generally tangential to the drum 108.

The unloading cassette 116 is also capable of performing a reciprocal linear movement up and down, arrow 144, from its nominal position, and a reciprocal linear movement towards and away from drum 108 as indicated by arrow 148.

The print head 104 is usually an array, or a number of arrays, of monochrome or color printing inkjet print heads. For example, for printing with four conventional printing colors cyan, magenta, yellow, and black, it could be an assembly of four different arrays. In another embodiment, the print head 104 is an assembly of eight individual arrays where in addition to four conventional printing colors a light cyan, light magenta, light yellow, and light black colors are added.

Figure 2:
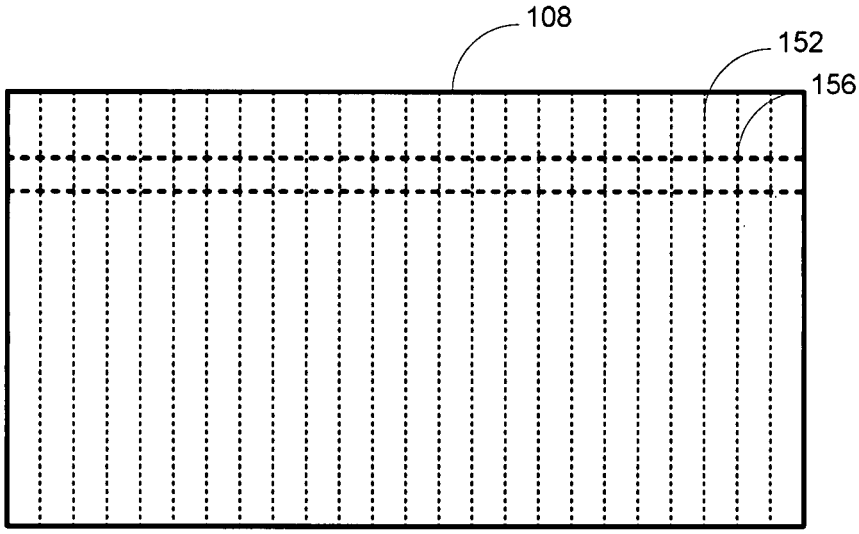
FIG. 2 is a schematic illustration of a frontal view of an exemplary embodiment of the drum of the printer illustrated in FIG. 1.

FIG. 2 is a schematic illustration of a frontal view of an exemplary embodiment of the drum 108 of the present printer. Drum 108 has a plurality of vacuum orifices/openings 152 and passageways distributed across the surface of the drum 108. Orifices 152 may be arranged in lines along the circumference of the drum and may be arranged in rows along the surface of drum 108, or in any other suitable array. Orifices 152 may be conventional orifices presenting an opening that communicates between the atmosphere and the inner section of drum 108. At least one row of orifices 152, for example, row 156 may be a row of smart orifices such as the orifices disclosed in Patent Cooperation Treaty Publications WO 03/060961 and WO 03/061354. Such orifices develop a substantially larger attraction force than conventional orifices 152.

In one mode of printing, printer 100 prints with eight colors. In another mode of printing the light cyan, magenta, yellow and black color print head arrays are purged and switched for operation with conventional cyan, magenta, yellow and black inks. This ink system switch instantly doubles the throughput of printer 100.

Drum 108 has no grippers or other mechanical substrate holding means. For substrate loading, drum 108 advances towards loading cassette 112 and locates over cassette 112 and the edge of upper sheet of substrate 114 placed into cassette 112. Drum rotation is initiated and it is synchronized with cassette 112 up or down movement, such that row 156 of smart orifices becomes aligned with the edge of substrate 114, or a section of substrate 114 immediate to the edge. Vacuum is activated and drum 108 contacts edge of substrate 114 with the row of smart orifices 156. Vacuum attaches substrate 114 to drum 108 and as the drum continues to rotate the substrate wraps around the drum 108. The level of vacuum is selected such as to firmly hold substrates of different weights. A roller 160 mounted proximate to the drum 108 and loading cassette 112 or an air stream from an air knife may assist in attaching the substrate to the drum surface. Concurrently with pulling substrate 114 from loading cassette 112 drum 108 returns to the nominal position at which printing is performed.

In another embodiment the drum 108 performs only a rotational movement around its axis 126. The loading cassette 112 moves up and down, and towards and away from the drum 108, with the final linear velocity equal to the linear velocity of the surface of the drum 108 and thereby loading/unloading the substrate 114 without discontinuing drum rotation. The displacement of the loading cassette 112 aligns the edge of the substrate 114 with the row of smart orifices 156, and the vacuum applied at the orifices 156 attaches substrate 114 to the drum 108. As the drum 108 continues to rotate, the substrate wraps around the drum 108. A roller 160 may be mounted proximate to the drum 108 and loading cassette 112 or an air stream from an air knife (not shown) may assist in attaching the substrate 114 to the surface of drum 108. Upon completion of substrate loading, the loading cassette 112 returns to the nominal position and the printing process is initiated. Substrate 114 loading and unloading processes are concurrent processes.

Depending on the printer architecture, unloading is performed in a similar manner. Either the drum 108 or unloading cassette 116 performs the movements required to detach the substrate 114 from drum 108 surface and receive it into the unloading cassette 116. The edge of the substrate 114 is detached by reversing vacuum direction and blowing an air stream through the vacuum orifices 152 and 156. The drum 108 continues to rotate and unloads the substrate 114 into the unloading cassette 116.

Alternatively, an array of pick-up fingers (not shown) may detach the edge of the substrate 114 from the drum 108 and continuous drum rotation then fully unloads the substrate 114 into the unloading cassette 116.

In one embodiment, eight print head arrays are operative to print, as explained above, an image with eight printing colors, which may for example be four conventional process colors with the addition of light cyan, light magenta, light yellow, and light black colors. In another embodiment, when higher throughput is required the inking system of the four light colors (LC, LM, LY, and LB) is purged by any known purging method and switched to four conventional print colors. This simple operation doubles the throughput of the printer 100.

Printed ink should be dried or cured to a condition that eliminates ink tackiness or smear and practically makes the printed substrate 114 ready for use. The present printer 100 prints with UV curable inks and the ink is cured by radiation energy emitted by the curing radiation source 124. In order to speed up the curing and improve the UV energy utilization source 124 utilizes an extended reflector 164. Such reflector construction distributes more evenly the curing radiation around the drum/substrate surface and allows conducting the ink curing process for a longer time with different curing energy level resulting in completely cured image.

The invention claimed is:

1. A printing method comprising:

loading a substrate onto a substrate carrier from a loading cassette;

printing an image onto said substrate; and unloading said substrate from said substrate carrier onto an unloading cassette, wherein said loading or unloading said substrate comprises displacing said substrate carrier relative to said loading cassette or unloading cassette, and wherein the displacing of said substrate carrier relative to the loading cassette or the unloading cassette comprises generally linear reciprocating movement of said substrate carrier relative to the loading cassette or the unloading cassette.

2. A method according to claim 1, further comprising displacing the loading cassette or the unloading cassette.

3. A method according to claim 2 in which displacing said loading cassette or unloading cassette comprises displacing the loading cassette or the unloading cassette along a path generally tangential to said substrate carrier.

4. A method according to claim 2 in which displacing said loading cassette or unloading cassette comprises displacing the loading cassette or the unloading cassette along a path generally radially relative to said substrate carrier.

5. A method according to claim 1 further comprising rotating said substrate carrier relative to the loading cassette or the unloading cassette.

6. A method according to claim 1, further comprising adhering said substrate to said substrate carrier by the application of a vacuum between said substrate and said substrate carrier.

7. A method according to claim 1, further comprising loading a second substrate while said substrate is unloaded.

8. A method according to claim 1, comprising directing curing radiation onto said substrate.

9. A printer comprising;

a substrate carrier to rotate about an axis relative to a print head adjacent the substrate carrier; and a substrate loading cassette and a substrate unloading cassette adjacent to and operatively coupled to the substrate carrier, wherein the substrate carrier is linearly displaceable by a generally linear reciprocating movement of the substrate carrier relative to the substrate loading cassette or the substrate unloading cassette during a loading or unloading operation.

10. A printer according to claim 9, wherein the substrate carrier is displaceable substantially horizontally or substantially vertically relative to the loading cassette or the unloading cassette.

11. A printer according to claim 9, wherein the substrate carrier comprises a drum having vacuum orifices to hold the substrate.

12. A printer according to claim 9, wherein the loading cassette or the unloading cassette is movable relative to the substrate carrier.

13. A printer according to claim 12, wherein the loading cassette or the unloading cassette is linearly movable relative to the substrate carrier.

14. A printer according to claim 12, wherein the loading cassette or the unloading cassette is movable generally tangential relative to the substrate carrier.

15. A printer according to claim 12, wherein the loading cassette or the unloading cassette is movable generally radially relative to the substrate carrier.

16. A printer, comprising:

a substrate carrier;

a loading cassette adjacent the substrate carrier to load a substrate onto the substrate carrier; and an unloading cassette adjacent the substrate carrier to unload the substrate from the substrate carrier, wherein to load or unload the substrate from the substrate carrier, the substrate carrier is to translate relative to the loading cassette or the unloading cassette by a reciprocating movement of the substrate carrier along a generally linear path.

17. A printer according to claim 16, wherein the loading cassette or the unloading cassette is movable relative to the substrate carrier.

18. A printer according to claim 17, wherein the loading cassette or the unloading cassette is movable generally tangential relative to the substrate carrier or generally radially relative to the substrate carrier.

* * * * *